United States Patent [19]

Wenaas et al.

[11] Patent Number: 4,660,014

[45] Date of Patent: Apr. 21, 1987

[54] ELECTROMAGNETIC PULSE ISOLATION TRANSFORMER

[75] Inventors: Eric P. Wenaas, Del Mar; Ralph M. Wheeler, San Diego, both of Calif.

[73] Assignee: Jaycor, San Diego, Calif.

[21] Appl. No.: 747,000

[22] Filed: Jun. 19, 1985

[51] Int. Cl.[4] ..... H01F 15/04

[52] U.S. Cl. ..... 336/84 C; 336/92; 336/210

[58] Field of Search ..... 307/89, 91; 336/84 R, 336/84 C, 92, 90, 69, 70, 210; 361/38

[56] References Cited

U.S. PATENT DOCUMENTS

| | | | |
|---|---|---|---|
| 676,105 | 6/1901 | Thomas . | |
| 1,019,512 | 3/1912 | Moody . | |
| 1,683,783 | 9/1928 | Kelloway . | |
| 2,114,189 | 4/1938 | Kronmiller | 336/84 C |
| 2,343,725 | 3/1944 | Wilson | 336/84 C |
| 2,533,920 | 12/1950 | Crook | 336/84 C X |
| 2,547,649 | 4/1951 | Marsh | 336/84 C |
| 2,904,762 | 9/1959 | Schulz | 336/84 C |
| 2,993,146 | 7/1961 | Winter . | |
| 3,039,042 | 6/1962 | Chatterton | 336/84 C X |
| 3,327,268 | 6/1967 | Rabus | 336/84 |
| 3,539,959 | 11/1970 | Wildi | 336/60 |
| 3,851,287 | 11/1974 | Miller et al. | 336/84 |
| 4,464,544 | 8/1984 | Klein | 179/113 |
| 4,484,171 | 11/1984 | McLoughlin | 336/84 R |

*Primary Examiner*—Thomas J. Kozma

*Attorney, Agent, or Firm*—Fitch, Even, Tabin & Flannery

[57] ABSTRACT

An isolation transformer for connection between a source of alternating current power and electrical components, the operation of which components is affected by voltage excursions occasioned by electromagnetic pulses. The transformer includes a ferromagnetic core including first and second ends and at least two legs extending between the ends and defining therewith at least one window in the core. Also included are a primary coil surrounding a first portion of the core and extending through a window in the core, and a secondary coil, spaced from the primary, surrounding a second portion of the core and extending through a window in the core. A metallic isolation shield is positioned between the coils with the shield having core apertures for receiving components of the core so that the shield passes through each window of the core. A first metallic housing is mounted on the shield and has an opening for receiving the primary coil and the portion of the core on the primary coil side of the shield. An electrically conductive foil is wrapped about and insulated from the wires in the primary coil and electrically connected to the housing so that the housing, the shield and the foil form a Faraday cage. The primary coil has leads passing through the foil and outside the housing with the shield extending beyond the housing to form a mounting flange for the transformer.

14 Claims, 14 Drawing Figures

COMMON-MODE TRANSFORMER ISOLATION
($V_O/V_{IN}$ OR $I_O/I_{IN}$) WITH 50 Ω LEAD

COMMON-MODE TRANSFORMER ISOLATION ( $I_O/I_{IN}$ ) FOR SHORT-CIRCUIT LOAD

COMMON-MODE TRANSFORMER ISOLATION
( $V_O/V_{IN}$ ) FOR OPEN-CIRCUIT LOAD )

ELECTROMAGNETIC PULSE ISOLATION TRANSFORMER

This invention was made with Government support under DNA 001-84-C-0295 awarded by the Defense Nuclear Agency. The Government has certain rights in this invention.

The present invention relates to transformers and, more particularly, to an isolation transformer which provides electromagnetic pulse (EMP) isolation between a source of alternating current power and electronic components the operation of which is adversely affected by voltage excursions occasioned by such pulses.

BACKGROUND OF THE INVENTION

Isolation is required between a source of alternating current power and sensitive electronic components, such as logic circuitry, to prevent electronic system malfunctions from EMP induced upset and/or burnout of the electronic components arising from EMP sources such as a nuclear detonation. It is known to use filters and surge arrestor devices, such as spark gaps and zener diodes, with transformers for isolation on power lines and on low frequency lines. With capacitive and/or inductive filters, the isolation afforded is dependent on source or load impedance, and saturation of the transformer core during a high current pulse degrades isolation. Furthermore, with such filters there is a possibility of high voltage arcing from the transformer primary to the secondary, high power factors, and increased weight and decreased reliability due to the presence of additional electrical components. The use of spark gaps also imposes additional space and weight penalties, and zener diodes can be burned out by a high current pulse.

A previously patented isolation transformer for protecting sensitive electronic equipment from voltage excursions caused by electromagnetic and electrostatic interference (which is typically below 1 MHz.) includes a metallic shield disposed between the primary winding and the secondary winding. This shield, formed by overlapping plates, fits within the transformer core and has extending ends which are enclosed by the end bells of the transformer. The end bells are provided with mounting legs for use in attachment of the transformer to supporting structure. For further information concerning the structure and operation of this transformer, reference may be made to U.S. Pat. No. 4,484,171.

SUMMARY OF THE INVENTION

Among the various aspects and features of the present invention may be noted the provision of an improved isolation transformer for protecting against interference due to EMP which has a frequency component ranging to hundreds of MHz. The transformer includes a metallic shield between the primary coil and the secondary coil which may, in effect, have dimensions much greater than other components of the transformer because a metallic wall of the enclosure of the electronic components to be protected can be included to form an extension of the shield. The shield is also part of a first Faraday cage encompassing the primary coil, and also forms part of a second Faraday cage surrounding the secondary coil.

This EMP isolation transformer provides both common-mode and differential-mode high frequency attenuation. Common-mode interference occurs when variations in voltage applied to both leads of the primary winding are equal in amplitude and are in phase. This type of interference is dominated by electric field coupling and is transmitted from the primary to the secondary in proportion to interwinding capacitance and not as a result of normal (inductive) transformer action. Differential mode is the normal operating mode of the transformer and occurs when the signals applied to the primary winding are 180° out of phase. Coupling to the secondary is through regular transformer action of an iron core transformer at low frequency. Differential-mode isolation occurs at higher frequencies because the transformer core will not respond at those frequencies, and the added Faraday shield of the coils provides attenuation of any high frequency flux which is created as a differential signal. The transformer of the present invention offers common-mode signal rejection above the break or critical frequency (the frequency at which the skin depth equals the shield thickness) which can be selected to be between 1 and 50 kHz, depending on selection of appropriate design parameters. The shielding factor, the ratio of input to output voltage or current, for common-mode signal rejection is in the range of 70 to 100 dB. Because the transformer of the present invention can be designed to occupy substantially the same volume as a prior art transformer having the same normal transformer action characteristics, the novel transformer can easily replace existing transformers without extensive modification of any supporting structure. Additionally, the subject transformer is of relatively light weight, is reliable in use and has long service life and is relatively easy and economical to manufacture. Other features of the transformer will be, in part, apparent and, in part, pointed out hereinafter in the following specification and accompanying claims and drawings.

Briefly, the isolation transformer of the present invention includes a ferromagnetic core defining at least one window. A primary coil surrounds a portion of the core and extends through the window, and a secondary coil, spaced from the primary coil, surrounds another portion of the core and extends through the window. A metallic isolation shield is positioned between the primary and the secondary coils, and a first metallic housing is mounted on the shield. The housing has an opening for receiving the primary coil and the portion of the core on the primary coil side of the shield. The primary coil has a foil wrapping about the turns of wire in the coil. The foil is electrically connected to the housing so that the housing, the shield and the foil form a first Faraday cage. The leads of the primary coil pass through the foil and outside the housing with the shield extending beyond the housing, to form a mounting flange for the transformer.

BRIEF DESCRIPTION OF THE DRAWINGS

Corresponding reference characters indicate corresponding components throughout the several views of the drawings.

DESCRIPTION OF THE PREFERRED EMBODIMENTS

Figure 1:
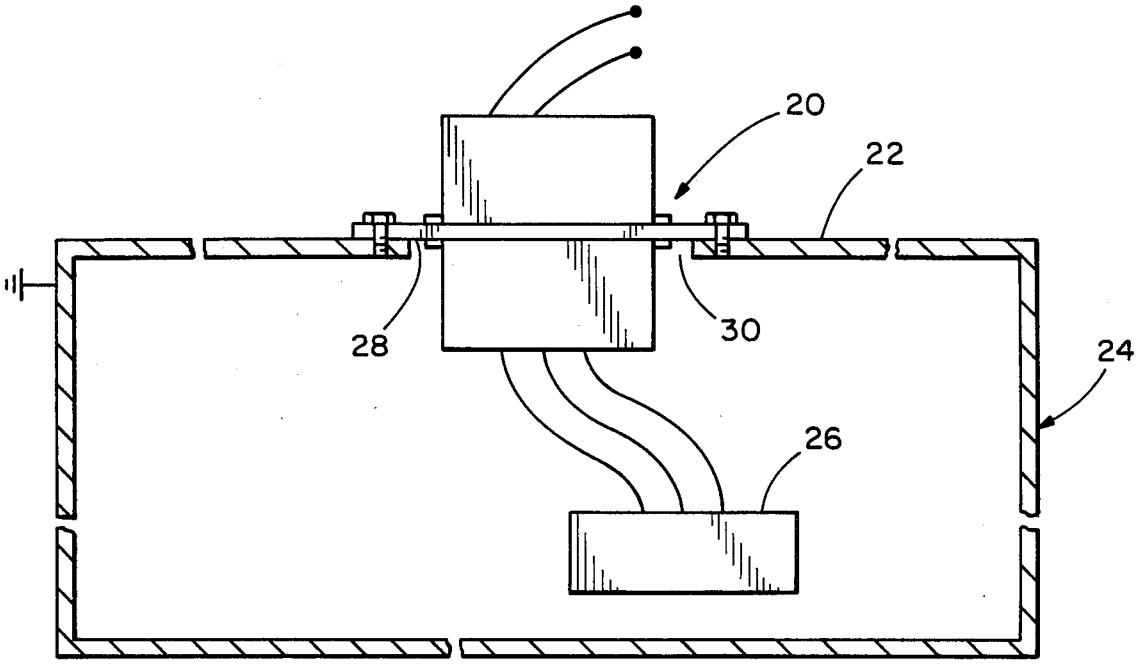
FIG. 1 illustrates one preferred embodiment of an isolation transformer including various features of the present invention mounted in an opening in a metallic wall which is part of an enclosure for electronic components.

Referring now to the drawings, one embodiment of an isolation transformer embodying various features of the present invention is generally indicated in FIG. 1 by reference number 20. The transformer is preferably mounted on a metallic shield wall 22 which preferably forms part of an enclosure 24 for electrical or electronic components 26, the operation of which is adversely affected by an electromagnetic pulse resulting, for example, from a nuclear detonation. Such a detonation produces a broad band burst of energy including components having frequencies up to 500 MHz. The transformer 20 includes a metallic plate 28 forming an isolation shield which extends beyond the transformer windings. The shield wall 22 has an opening 30 sized to receive a portion of the transformer so that the plate 28 can be used as a mounting flange for attachment to the wall 22. The periphery of the plate 28 is preferably bonded to the wall 22 using a conductor, i.e., solder, weld or bolt, so that the metallic wall 22 functions electrically as an extension of the plate 28.

Figure 2:
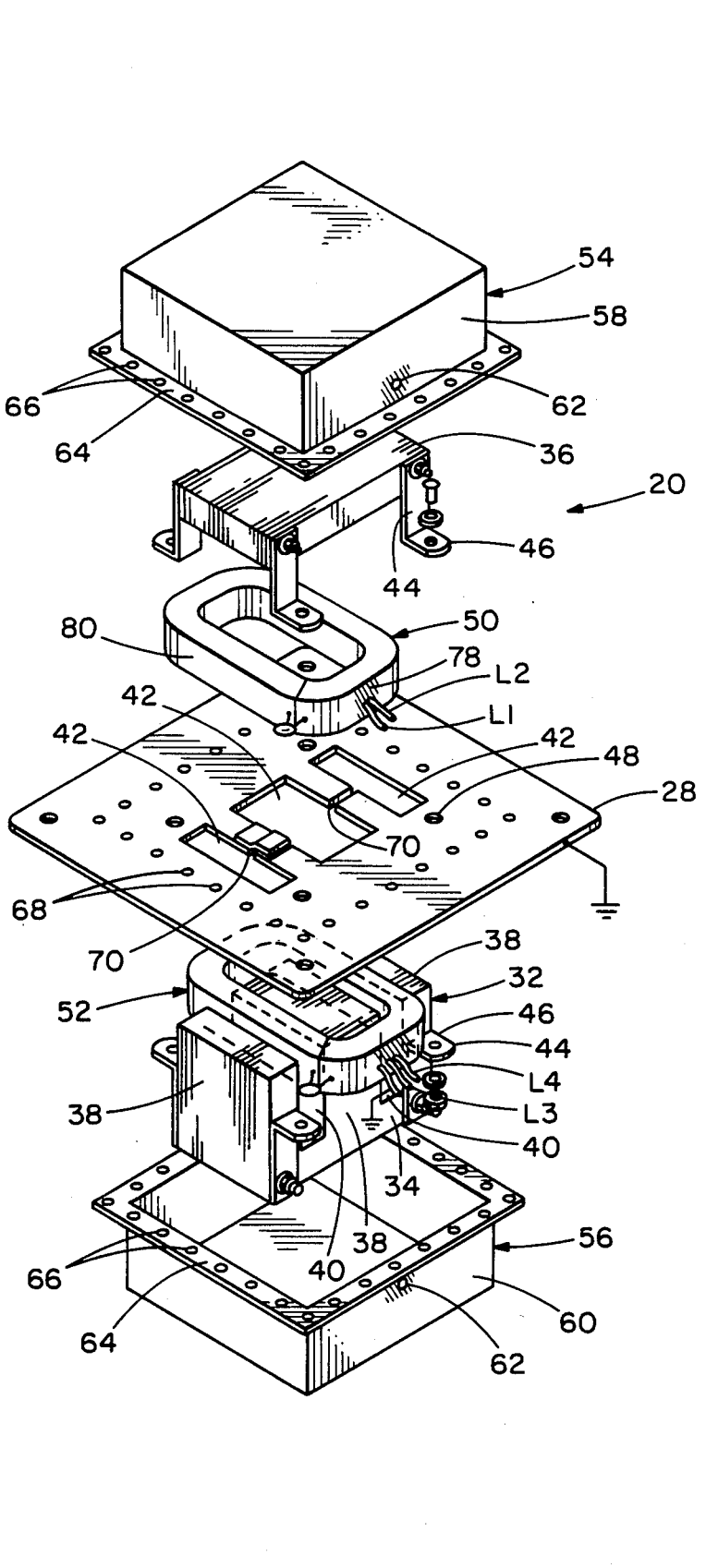
FIG. 2 is an exploded isometric view of certain components of the transformer of FIG. 1 which includes an isolation plate positioned between a primary coil and a secondary coil with each coil covered by a housing attached to the plate and the plate extending beyond the housings and serving as a mounting flange.

More specifically, as best shown in FIG. 2, the transformer 20 includes a ferromagnetic core 32 formed by laminations and having a first end 34, a second end 36 and a trio of spaced parallel legs 38 extending between the ends 34, 36 and forming therewith a pair of windows 40. The plate 28 has three spaced apertures 42 sized to receive corresponding legs 38 of the core. The core first end 34 and the legs 38 are preferably unitary and form an "E" configuration. Angled mounting brackets 44 are shown bolted to each end, and each bracket has an apertured foot 46 for alignment with a corresponding hole 48 in the plate 28 so that one bracket from each core end can receive a bolt extending through a hole 48 to form the completed core 32, with the plate 28 held between the core ends. The transformer further includes a primary coil or winding 50 surrounding the central leg 38 and extending through the windows 40 on one side of the plate, and a secondary coil 52 disposed on the other side of the plate encompassing the central leg and passing through the windows.

A first metallic isolation housing 54 has an open bottom and receives the primary coil 50 and the portion of the core on the primary coil side of the plate 28. Similarly, a second metallic isolation housing 56 has an opening and accepts the secondary coil 52 and the portion of the core on the secondary side of the isolation plate. The isolation housings 54, 56 have side walls 58, 60, respectively, having a small passage 62 for exit of the corresponding leads L1 and L2 from the primary coil and leads L3 and L4 from the secondary coil. Each housing is provided with a peripheral, outwardly directed mounting skirt 64 having a series of mounting holes 66 matching a series of holes 68 in the isolation plate 28 to permit attachment of the housings to the plate. The isolation housings 54 and 56 also function to offer mechanical protection for other components of the transformer 20 and, as will be discussed more fully hereinafter, preclude the need for shielded cables to be used for connection to the transformer.

Figure 4:
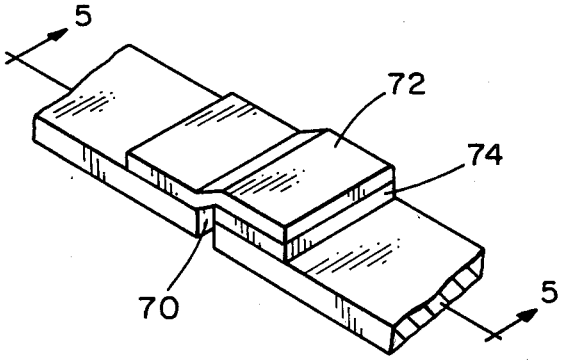
FIG. 4 is an isometric view of a portion of the isolation plate depicting a slot between adjacent core-receiving windows to reduce hysteresis losses, with the slot bridged by a conductive arm, one end of which is insulated, to reduce radiation leakage.
Figure 5:
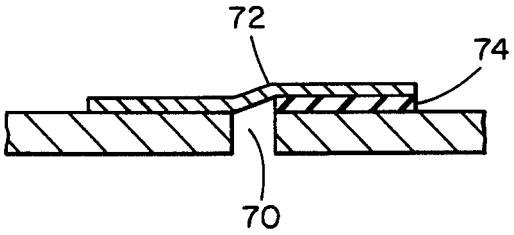
FIG. 5 is a sectional view through the arm, taken generally along line 5—5 of FIG. 4.
Figure 6:
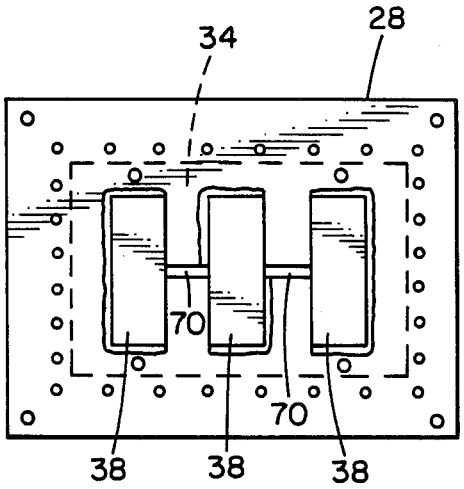
FIG. 6 is a plan view of the isolation plate showing areas where the legs of the core may be soldered to the plate.

The isolation plate 28 has a slot 70 extending between each adjacent pair of core apertures 42 to interrupt the electrically conductive path in the plate around the core aperture thereby reducing eddy current losses. As best shown in FIGS. 4 and 5, radiation leakage through the slots, which would be a factor at higher frequencies, is limited by metallic arms 72 bridging each slot 70. One end of each arm 72 is electrically connected to the plate material on one side of a corresponding slot with the other end of the arm spaced from the plate material on the other side of the slot by an insulator 74. Referring to FIG. 6, any leakage that might result from a core aperture 42 being slightly larger than the core leg 38 passing through it, so that the core legs 38 are not received in an interference fit, is reduced by soldering the core leg to the plate material defining the slot. The entire periphery of the leg is not soldered to preclude information of a closed conductive path to reduce eddy current losses.

Figure 3:
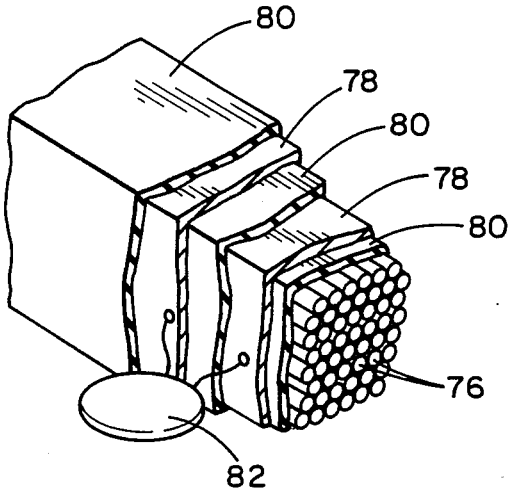
FIG. 3 is an isometric view of a portion of the primary coil illustrating a pair of overlapping conductive wraps about the primary coil wires which are insulated from each other and the wires and which may be connected to a capacitor.
Figure 3A:
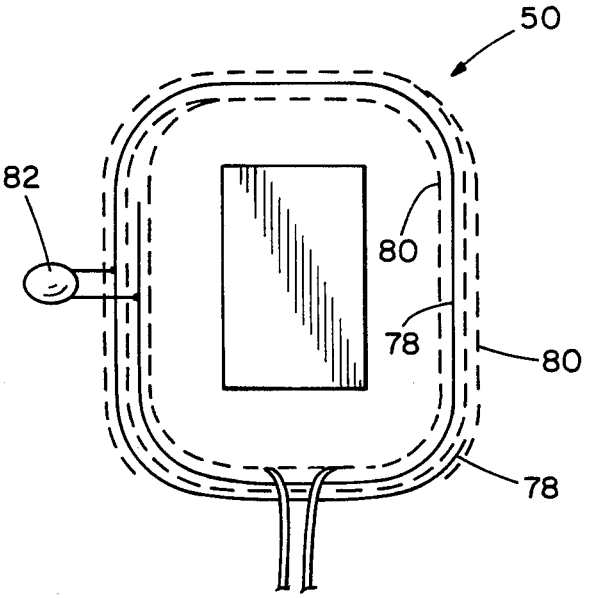
FIG. 3A is a plan view of the primary coil showing how the foil wraps overlap without forming a complete conductive loop about the periphery of the coil.

Assuming the primary coil and secondary coil have an identical number of turns, their construction is substantially identical so only the primary coil 50 need be described in detail. As best shown in FIGS. 3 and 3A, the primary coil is formed by a number of turns of wire 76. Wrapped about the grouping of wires is a conductive foil 78 which functions to further reduce coupling which could result from the slots, core aperture or a small gap in the laminations forming the core. That is, the leads L1 and L2 would act as antennas receiving the high frequency components of the high energy burst resulting from a nuclear detonation. The energy thus received by the primary coil 50 could be transferred to the secondary coil 52 (and thus the electronic components 26) through capacitive or electrostatic coupling. The presence of the foil 78, which surrounds the primary coil 50 and is connected to ground, greatly reduces the capacitive coupling between the coils 50, 52.

The foil 78 is spirally wrapped about the wires 76 with layers of insulation 80 spacing the foil from the wires and from the overlapping inner and outer ends of the foil wrap to prevent formation of a closed conductive path in the foil which would result in eddy current losses. Additionally, a layer of the insulation is placed about the outside of the foil for mechanical protection of the foil. Additional isolation between the ends of the foil wrap can be effected by connecting them with the leads of a capacitor 82.

Referring to FIG. 2, a portion of the outer layer 80 of insulation about leads L1 and L2 is removed and the exposed outer layer 78 of the foil is soldered to the facing inner surface of the side wall 58 of the first housing 54 at passage 62. In this manner, the housing 54, the foil wrap 78 and the isolation plate 28 form a first Faraday cage encompassing the primary coil 50. Preferably, the skirt 64 of the housing 54 is circumferentially soldered to the isolation plate 28, although close-spaced bolts also provide the RF shielding needed. Similarly, the second housing 56, a foil wrap 78 about the secondary coil 52 and the isolation plate 28 form a second Faraday cage for the secondary coil.

Figure 7:
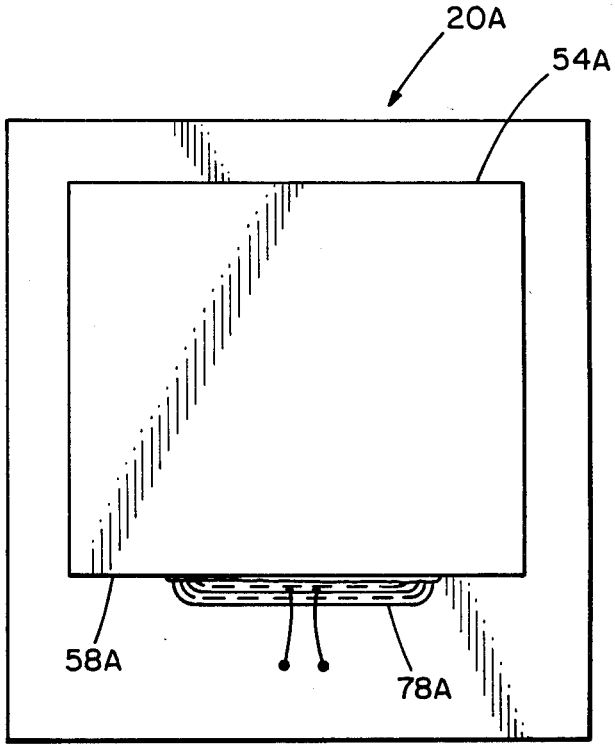
FIG. 7 is a plan view of an alternative embodiment of the transformer of the present invention wherein the coils extend partially through openings in their corresponding housings with the conductive wraps on the respective coils soldered to material of the housings defining those openings.
Figure 8:
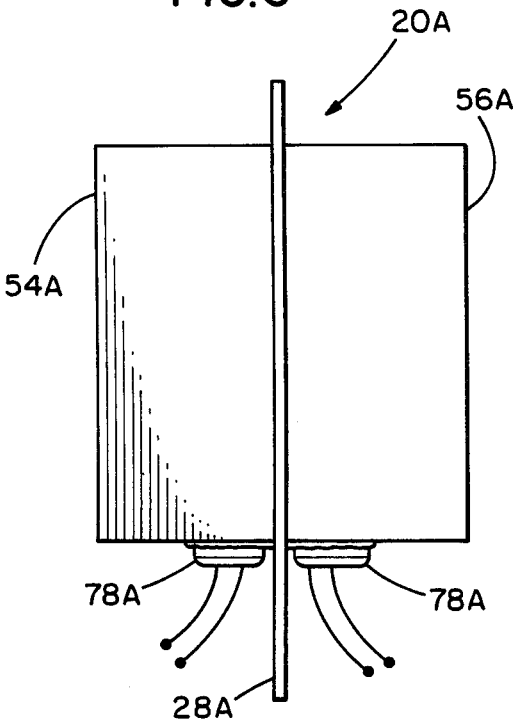
FIG. 8 is a side elevational view of the transformer of FIG. 7.
Figure 9:
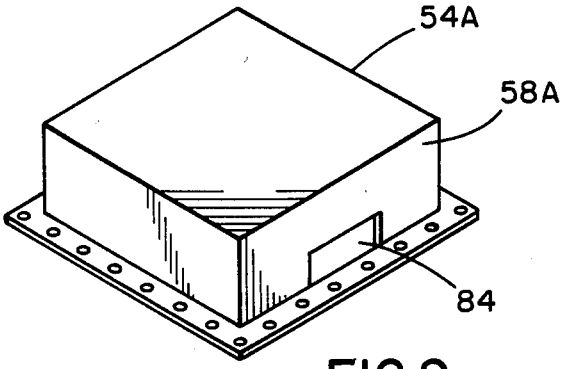
FIG. 9 is an isometric view of an isolation housing used in the transformer of FIG. 7.

Referring to FIGS. 7–9, an alternative embodiment of the transformer of the present invention is indicated by reference character 20A. Components of the transformer 20A corresponding to components of the transformer 20 are indicated by the reference numeral applied to the component of the transformer 20 with the addition of the suffix "A". The transformer 20A is substantially identical to the transformer 20 with the exception that the primary coil 50A and the secondary coil 52A are not fully contained in their respective isolation housings 54A and 56A, but extend partially outside them to permit adhesive bonding (soldering) to the housing about the periphery of the extension. As both isolation housings are substantially identical, only the housing 54A (shown in FIG. 9) need be described. The housing 54A includes a generally rectangular second opening 84 in its side wall 58A, which opening 84 extends adjacent to the isolation plate 28A when the components are assembled so that the foil wrap 78A of the primary coil can also be bonded to the isolation plate. The coils extend slightly beyond the respective side walls of the corresponding housings, as shown in FIGS. 7 and 8, so that the foil wrap 78A, with the appropriate portion of the outer layer of insulation 80A removed to expose the wrap, can be soldered along both sides and the top to the isolation housing and along the bottom on the extension to the isolation plate 28A. Thus, in the alternative embodiment also, each coil is disposed in a Faraday cage formed by an isolation housing, the foil wrap of that coil and the isolation plate 28A.

Preferably, the isolation plate 28 is made of bronze, the foil wrap 78 is copper, the housings 54 and 56 are copper, bronze or aluminum.

The transformer 20 of the present invention provides protection in the frequency range of 1 MHz to 1 GHz where other electromagnetic compatibility/electromagnetic interference (EMC/EMI) isolation transformers fail to provide significant protection. Accordingly, the transformer 20 is of particular interest for hardening electrical systems to nuclear EMP sources, where existing transformers provide no significant protection. This protection results from the fact that the isolation plate 28 has, in effect, dimensions much greater than those of the remainder of the transformer because the metallic shield wall 22 acts as an extension of the isolation plate. With prior art designs in which the isolation plate had approximately the same dimensions as the remainder of the transformer, stray capacity could be formed around the plate to reduce signal rejection at higher frequencies. Additionally, the transformer 20 includes the double Faraday cage, one for each coil, to greatly reduce leakage, which would otherwise result in capacitive coupling of the primary and secondary coils, thereby transmitting the interference signal to the electronic components to be isolated therefrom. The shielding materials, i.e., the plate 28, the foil wrap 78 and the housings 54 and 56, have insignificant weight compared to that of the heavy core 32. Thus, the increase in weight of the isolation transformer 20 over a standard non-isolation, transformer is not significant. As the primary coil 50 and the secondary coil 52 are isolated from one another by the isolation plate 28 which is essentially solid, any arc produced by the application of an overvoltage at the primary coil cannot reach the secondary coil.

Figure 10:
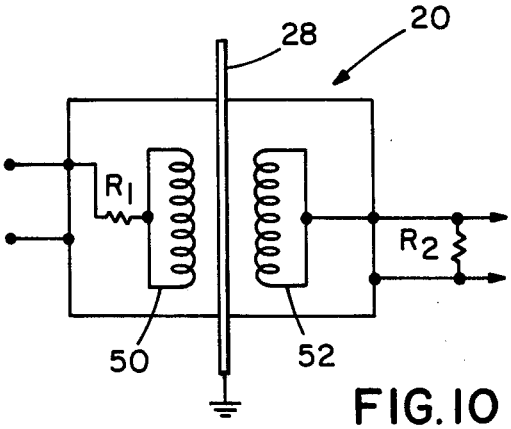
FIG. 10 is a schematic diagram illustrating testing of the transformer of the present invention for common-mode signal rejection.
Figure 11:
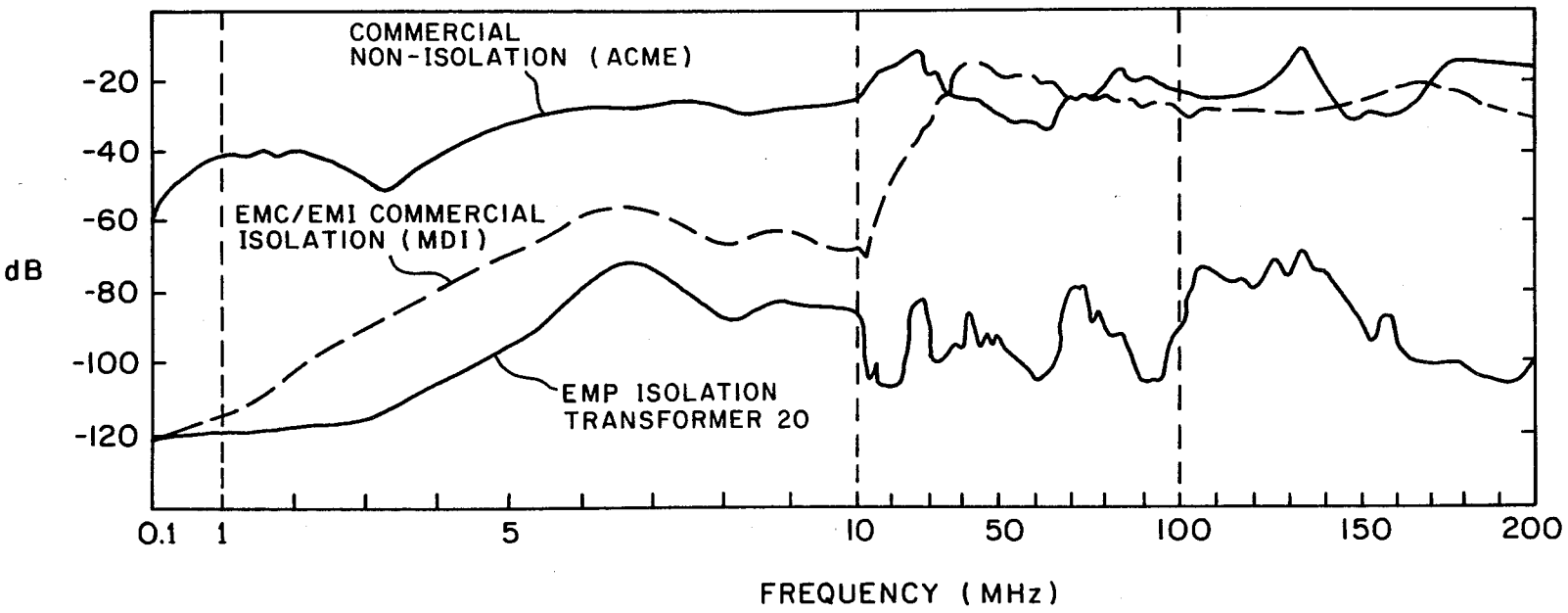
FIG. 11 is a graph illustrating the results of testing the transformer of the present invention against a commercial non-isolation transformer and a commercial isolation transformer for common-mode signal rejection with a 50 ohm load.
Figure 12:
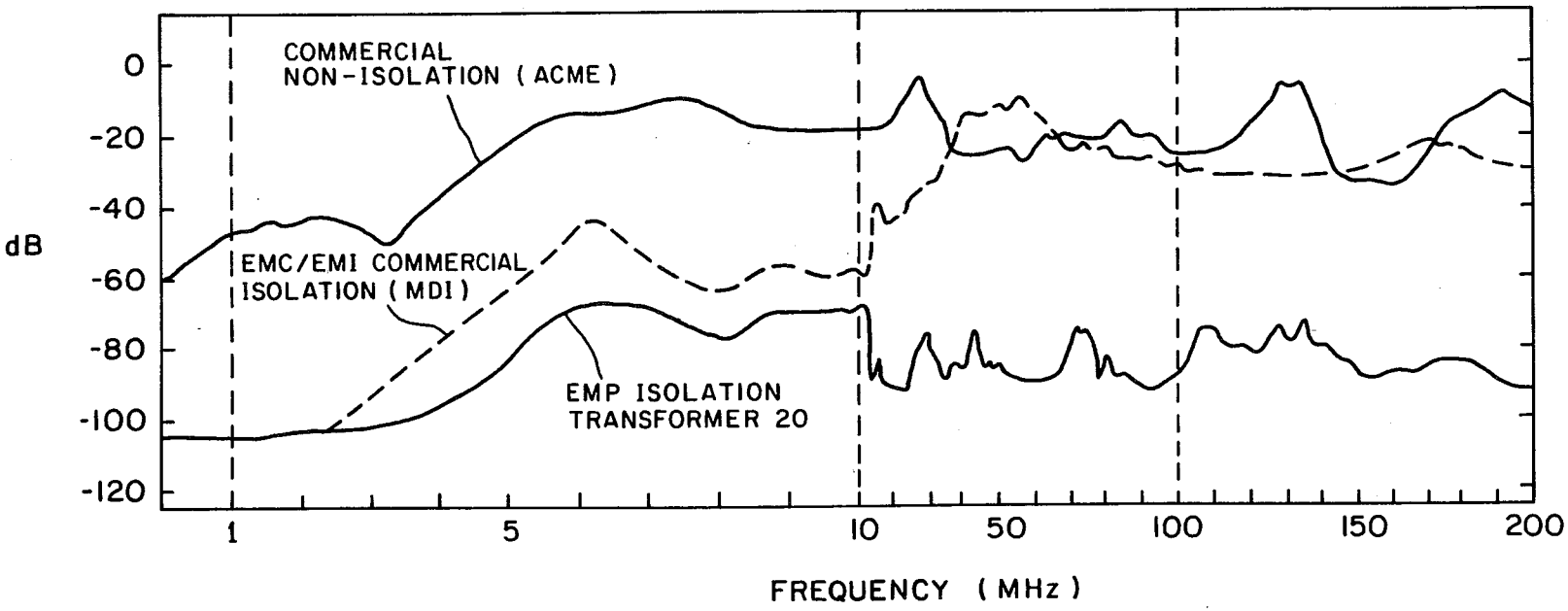
FIG. 12 is a graph illustrating the results of comparative testing of such transformers for common-mode signal rejection with a short-circuited load.
Figure 13:
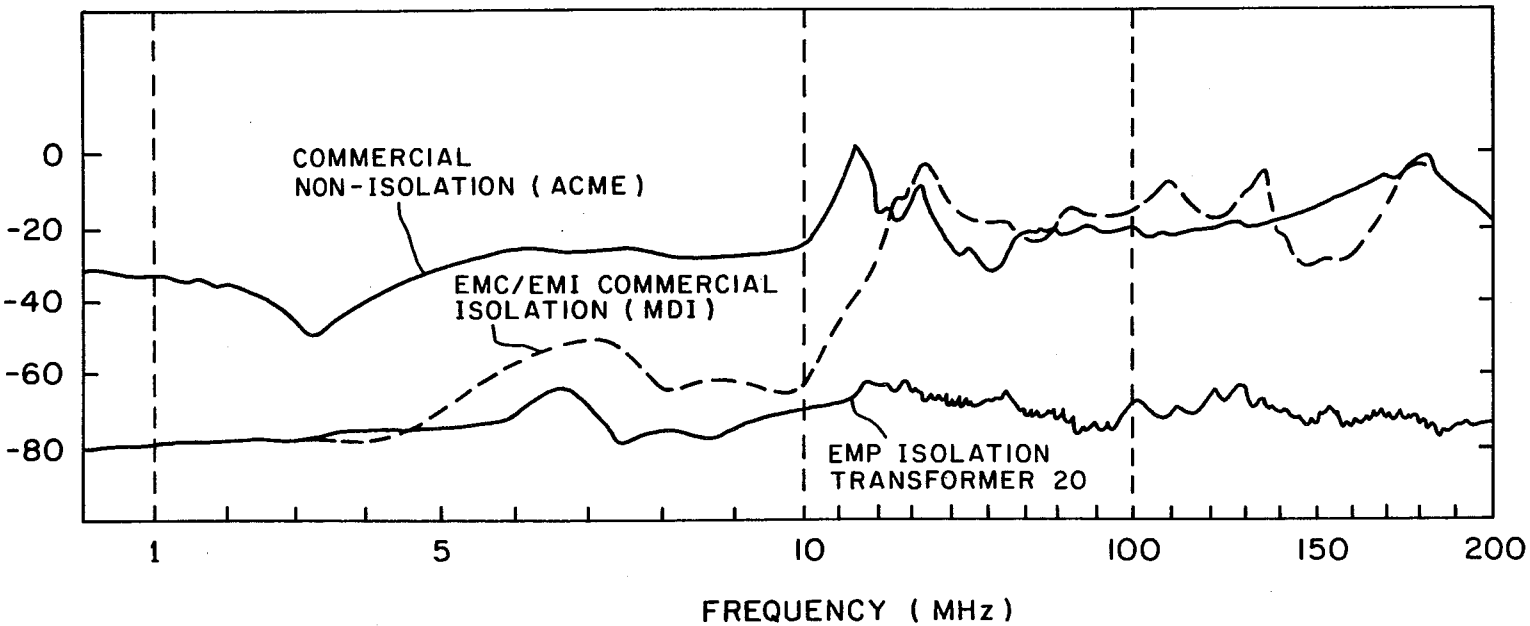
FIG. 13 is a graph illustrating the results of comparative testing of such transformers for common-mode signal rejection with an open-circuited load.

The transformer 20 was tested against an off-the-shelf, commercial non-isolation power transformer manufactured by ACME and a commercial EMC/EMI isolation transformer manufactured by Magnetic Devices, Inc. (MDI). The three transformers were of substantially the same size and rating. The core 32 and the coils 50 and 52 for the transformer 20 were purchased from MDI and are substantially identical to those of the MDI transformer participating in the testing. In the MDI transformer the foil wraps about the coils are grounded to the core of the transformer by short lengths of wire. Testing was for common-mode shielding effectiveness. FIG. 10 is a schematic diagram illustrating the connection of the transformer 20 for the common-mode signal rejection. The results of the testing for a 50 ohm load, a short circuit and an open circuit load are shown in FIGS. 11, 12 and 13, respectively. The isolation, or transmission loss between the primary coil and secondary coil measured in decibels, provided by the transformer 20 is approximately equal to that provided by the commercial isolation transformer at frequencies below one MHz. However, the isolation transformer 20 provides from 40 dB to 80 dB greater isolation than either the non-isolation transformer or the commercial EMC/EMI isolation transformer at frequencies above one MHz. The minimum isolation provided by the transformer above one MHz is approximately 70 dB while the minimum isolation provided by the commercial EMC/EMI transformer is only 10 to 15 dB. This improvement in isolation is caused by the provision of the isolation plate 28 which is, in effect, extended by the enclosure wall 22 to reduce stray capacity; and by the provision of the double Faraday cages formed by the housings, foil wraps and the isolation plate.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An isolation transformer for connection between a source of alternating current power and electronic components, the operation of which is adversely affected by voltage excursions caused by electromagnetic pulses, said transformer comprising:

a core defining at least one window;

a primary coil surrounding a first portion of said core and extending through a said at least one window in said core;

a secondary coil, spaced from said primary coil, surrounding a second portion of said core and extending through a said at least one window in said core;

a metallic isolation plate disposed between said coils;

a metallic housing mounted on said plate and receiving said primary coil and the portion of said core on the primary coil side of said plate; and an electrically conductive coating disposed about said primary coil and insulated therefrom, said coating being electrically connected to said housing so that said housing, said plate and said coating form a Faraday cage, said plate extending beyond said housing and forming a mounting flange for said transformer.

2. An isolation transformer for connection between a source of alternating current power and electronic components, the operation of which components is adversely affected by voltage excursions occasioned by electromagnetic pulses, said transformer comprising:

a ferromagnetic core including a first end, a second end and at least two legs extending intermediate said ends and defining therewith at least one window in said core;

a primary coil surrounding a first portion of said core and extending through a said at least one window in said core;

a secondary coil, spaced from said primary coil, surrounding a second portion of said core and extending through a said at least one window in said core;

a metallic isolation shield disposed between said primary coil and said secondary coil, said shield having core apertures for receiving components of said core so that said shield passes through each window of said core;

a first metallic housing mounted on said shield and having an opening for receiving said primary coil and the portion of said core on the primary coil side of said shield; and an electrically conductive first foil wrapped about and insulated from said primary coil and electrically connected to said housing so that said housing, said shield and said foil form a first Faraday cage, said primary coil having leads passing through said foil and outside said housing with said shield extending beyond said housing to form a mounting flange for said transformer.

3. A transformer as set forth in claim 2 further comprising a second metallic housing mounted on said shield and having an opening for receiving said secondary coil and the portion of said core on the secondary winding side of said shield.

4. A transformer as set forth in claim 3 further including an electrically conductive second foil wrapped about and insulated from said secondary coil and electrically connected to said second housing so that said second housing, said shield and said second foil form a second Faraday cage, said secondary coil having leads passing through said second foil and outside said second housing.

5. A transformer as set forth in claim 2 wherein said metallic housing has a second opening through which said first foil extends, said foil being bonded by electrically conductive means to material of said first metallic housing defining said second opening.

6. A transformer as set forth in claim 5 wherein said second opening extends adjacent to said isolation shield, said foil being bonded by electrically conductive means to said shield.

7. A transformer as set forth in claim 2 wherein said shield is a plate having a plurality of spaced mounting apertures disposed adjacent its periphery.

8. A transformer as set forth in claim 2 wherein there is a plurality of apertures and said shield has a slot extending between each pair of adjacent apertures to interrupt the electrically conductive paths about those core apertures formed by shield material defining those core apertures, thereby reducing eddy current losses.

9. A transformer as set forth in claim 8 wherein one leg of said core passes through a corresponding one of said core apertures, each leg being bonded to the shield material defining its corresponding core aperture by electrically conductive bonding means terminating short of the slot extending to that core aperture.

10. A transformer as set forth in claim 8 wherein said slot is bridged by a metallic arm connected to the shield on one side of said slot and spaced from the shield on the other side of the slot by an insulator, thereby reducing radiation leakage.

11. A transformer as set forth in claim 2 wherein said first foil has a first end and a second end, said foil being spirally wrapped about the wires of said primary coil, said foil forming at least two layers about the periphery of said primary coil with said layers being insulated from each other by a layer of insulation so that said foil does not make a closed electrically conductive path around the periphery of said primary coil.

12. A transformer as set forth in claim 11 further comprising a capacitor connected between said layers of said foil.

13. An isolation transformer system for connection between a source of alternating current power and electronic components, the operation of which components is adversely affected by voltage excursions caused by electromagnetic pulses, said system comprising an enclosure for said electronic components having a metallic wall with an opening therethrough, said system further including an isolation transformer comprising:

a ferromagnetic core including a first end, a second end and at least two legs extending intermediate between said ends and defining therewith at least one window in said core;

a primary coil surrounding a first portion of said core and extending through a said at least one window in said core;

a secondary coil, spaced from said primary coil, surrounding a second portion of said core and extending through a said at least one window in said core;

a metallic isolation shield disposed between said primary coil and said secondary coil, said shield having core apertures for receiving components of said core so that said shield passes through each window of said core;

a first metallic housing mounted on said shield and having an opening receiving said primary coil and the portion of said core on the primary winding side of said shield;

an electrically conductive first foil wrapped about said primary coil and insulated therefrom and electrically connected to said housing so that said housing, said shield and said foil form a Faraday cage, said primary coil having leads passing through said foil and outside said housing with said shield extending beyond said housing to form a mounting flange for said transformer, said flange being fastened to material defining the opening in said wall of said enclosure.

14. An isolation transformer for connection between a source of alternating current power and electronic components, the operation of which is adversely affected by voltage excursions caused by electromagnetic pulses, said transformer comprising:

a ferromagnetic core defining at least one window;

a primary coil surrounding a first portion of said core and extending through a said at least one window in said core;

a secondary coil spaced from said primary coil, surrounding a second portion of said core and extending through a said at least one window in said core;

a metallic wall, which forms a part of an enclosure for said electronic components, disposed between said primary coil and said secondary coil, said wall having core apertures for receiving components of said core so that said wall passes through each window of said core;

a metallic housing mounted on said wall and receiving said primary coil and the portion of said core on the primary coil side of said wall; and an electrically conductive foil wrapped about and insulated from said primary coil and electrically connected to said housing so that said housing, said wall and said foil form a first Faraday cage, said wall forming an isolation shield for said transformer.

* * * * *